US010394190B2

(12) United States Patent
Lechot et al.

(10) Patent No.: US 10,394,190 B2
(45) Date of Patent: Aug. 27, 2019

(54) PROTECTION OF A BLADE RESONATOR MECHANISM AGAINST AXIAL SHOCKS

(71) Applicant: The Swatch Group Research and Development Ltd, Marin (CH)

(72) Inventors: Dominique Lechot, Les Reussilles (CH); Pascal Winkler, St-Blaise (CH); Gianni Di Domenico, Neuchatel (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 56 days.

(21) Appl. No.: 15/730,913

(22) Filed: Oct. 12, 2017

(65) Prior Publication Data

US 2018/0136607 A1 May 17, 2018

(30) Foreign Application Priority Data

Nov. 16, 2016 (EP) ..... 16199006

(51) Int. Cl.
*G04B 17/04* (2006.01)
*G04B 17/32* (2006.01)
(Continued)

(52) U.S. Cl.
CPC ..... *G04B 17/045* (2013.01); *G04B 17/32* (2013.01); *G04B 31/02* (2013.01); *G04B 43/002* (2013.01)

(58) Field of Classification Search
CPC ..... G04B 17/045; G04B 17/10; G04B 17/32; G04B 31/02; G04B 31/04; G04B 43/002
See application file for complete search history.

(56) References Cited

U.S. PATENT DOCUMENTS 3,318,087 A * 5/1967 Favre ..... G04B 17/04 310/36
3,352,000 A * 11/1967 Altenburger ..... G04B 17/045 228/136
(Continued)

FOREIGN PATENT DOCUMENTS

EP 3 035 127 A1 6/2016
EP 3 054 357 A1 8/2016
(Continued)

OTHER PUBLICATIONS

European Search Report dated May 16, 2017 in European Application 16199006.4, filed on Nov. 16, 2016 (with English Translation of Categories of cited documents).

*Primary Examiner* — Daniel P Wicklund
(74) *Attorney, Agent, or Firm* — Oblon, McClelland, Maier & Neustadt, L.L.P.

(57) ABSTRACT

A timepiece resonator mechanism includes a structure and an inertial element oscillating around an axis and subjected to restoring forces exerted by a plurality of elastic blades, each fixed directly or indirectly to the structure at a first end and fixed directly or indirectly to an inertial element at a second end. The elastic blade extends in a perpendicular plane to the pivot axis and is deformable substantially in this plane, where this resonator mechanism includes an axial stop including at least a lower axial stop and/or an upper axial stop, and the axial stop is arranged for the protection of the blade resonator mechanism against axial shocks in the direction of the axis.

17 Claims, 4 Drawing Sheets

(51) Int. Cl.
*G04B 31/02* (2006.01)
*G04B 43/00* (2006.01)

(56) References Cited

U.S. PATENT DOCUMENTS

| | | | | |
|---|---|---|---|---|
| 9,836,024 | B2 * | 12/2017 | Di Domenico | G04B 17/045 |
| 9,958,831 | B2 * | 5/2018 | Di Domenico | G04B 31/02 |
| 2015/0234354 | A1 * | 8/2015 | Henein | G04B 17/045<br>368/170 |
| 2016/0179058 | A1 | 6/2016 | Born et al. | |
| 2016/0223989 | A1 | 8/2016 | Winkler et al. | |
| 2018/0136609 | A1 * | 5/2018 | Winkler | G04B 17/045 |

FOREIGN PATENT DOCUMENTS

| | | | | |
|---|---|---|---|---|
| WO | WO 2017/055987 | A1 | 4/2017 | |
| WO | WO-2017068538 | A1 * | 4/2017 | G04B 15/06 |

* cited by examiner

PROTECTION OF A BLADE RESONATOR MECHANISM AGAINST AXIAL SHOCKS

This application claims priority from European Patent Application No. 16199006.4 filed on Nov. 16, 2016; the entire disclosure of which is incorporated herein by reference.

FIELD OF THE INVENTION

The invention relates to a timepiece resonator mechanism comprising a structure and at least one inertial element arranged to oscillate in a pivoting movement around a pivot axis with the centre of inertia of said at least one inertial element aligned on said pivot axis, wherein said at least one inertial element is subjected to restoring forces exerted by a plurality of elastic blades, each fixed directly or indirectly to said structure at a first end and fixed directly or indirectly to said at least one inertial element at a second end, and each said elastic blade extends in a perpendicular plane to said pivot axis and is deformable substantially in said perpendicular plane to said pivot axis, where said resonator mechanism comprises axial stop means comprising at least a lower axial stop and/or an upper axial stop, and said axial stop means are arranged to cooperate as stop rest with at least one of the movable components for the protection of said blade resonator mechanism against axial shocks in the direction of said pivot axis.

The invention also relates to a timepiece movement comprising at least one such resonator mechanism.

The invention also relates to a watch comprising a timepiece movement and/or such a resonator mechanism.

The invention relates to the field of timepiece resonators and more particularly those comprising elastic blades serving as restoring means for the working of the oscillator.

BACKGROUND OF THE INVENTION

Shock resistance is a sensitive issue for the majority of timepiece oscillators and in particular for resonators with crossed blades. In fact, in the case of out-of-plane shocks the stress undergone by the blades rapidly reaches very significant values, which accordingly reduces the path that the part can travel before yielding.

Shock absorbers for timepieces come in a numerous variants. However, their purpose is primarily to protect the fragile pivots of the shaft and not the elastic elements such as classically the spiral spring.

Document EP3054357A1 in the name of ETA Manufacture Horlogère Suisse SA describes a timepiece oscillator comprising a structure and distinct primary resonators that are temporally and geometrically phase shifted, each having a mass restored to the structure by an elastic restoring means. This oscillator comprises coupling means for interaction of the primary resonators comprising driving means to drive movement of a wheel train, which comprises drive and guide means arranged to drive and guide an articulated control means with transmission means, each articulated, at a distance from the control means with a mass of a primary resonator. The primary resonators and the wheel train are arranged so that the axes of the articulations of any two of the primary resonators and the articulation axis of the control means are never coplanar.

Document EP3035127A1 in the name of SWATCH GROUP RESEARCH & DEVELOPMENT Ltd describes a timepiece oscillator comprising a resonator formed by a tuning fork, which comprises at least two movable oscillating parts fixed to a connecting element by flexible elements, the geometry of which determines a virtual pivot axis of determined position in relation to a plate and around which the respective movable part oscillates, the centre of mass of which is merged in resting position with the respective virtual pivot axis.

For at least one movable part the flexible elements are formed from crossed elastic blades spaced from one another in two parallel planes, the projections of the directions of which on one of the parallel planes cross at the level of the virtual pivot axis of the movable part.

SUMMARY OF THE INVENTION

The invention proposes to limit the out-of-plane displacement path of the blades of a blade resonator and thus ensure a better resistance of the system.

For this purpose, the invention relates to a blade resonator mechanism.

The invention also relates to a timepiece movement comprising at least one such resonator mechanism.

The invention also relates to a watch comprising such a timepiece movement and/or such a resonator mechanism.

BRIEF DESCRIPTION OF THE DRAWINGS

Other characteristics and advantages of the invention will become clearer on reading the following detailed description with reference to the attached drawings, wherein:

FIGS. 5 to 7 in a similar manner to FIG. 4 show other variants of the second embodiment, where the upper and lower end faces of the shaft correspond to upper and lower complementary surfaces of the structure, which are all surfaces of revolution around the pivot axis and have a complementary profile in pairs with: in FIG. 5 female cylinders in the structure and male cylinders at the ends of the shaft, in FIG. 6 female cones in the structure and male cones at the ends of the shaft, in FIG. 7 male cones in the structure and female cones at the ends of the shaft;

DETAILED DESCRIPTION OF PREFERRED EMBODIMENTS

Figure 1:
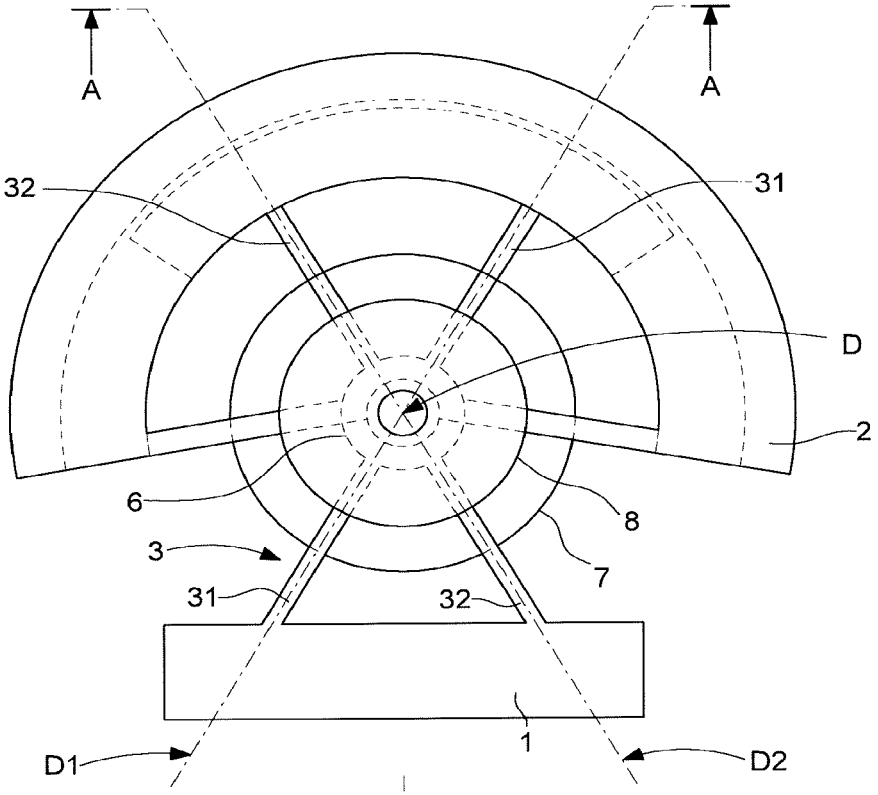
FIG. 1 is a schematic plan view of a first embodiment with a resonator mechanism with elastic blades comprising two parallel levels of elastic blades, wherein the directions in which these blades extend cross in projection at the level of a virtual pivot axis of an inertial element, which is suspended and restored by these elastic blades in relation to a fixed structure, and where this resonator mechanism comprises axial stop means to protect the blades in the case of shock that are illustrated in a non-restrictive manner in the form of two disc centred on the pivot axis: an upper transparent disc of small diameter arranged to limit the shake of the inertial element, which in this particular case forms a box surrounding and protecting the set of elastic blades, on the upper side and a lower disc of larger diameter arranged to limit the shake of this same inertial element on the lower side opposite this upper side, wherein the blades comprise an eye at the level of the pivot axis to allow a shaft to pass through, held here on the fixed structure not shown), and this shaft carries this upper disc and this lower disc.

The invention relates to a timepiece resonator mechanism 100 comprising a structure 1 and at least one inertial element 2 arranged to oscillate in a pivoting movement around a pivot axis D. The resulting centre of inertia of the set of inertial elements 2 is aligned to the pivot axis D.

At least one inertial element 2 is subjected to restoring forces exerted by a plurality of elastic blades 3, each fixed directly or indirectly to the structure 1 at a first end 301 and fixed directly or indirectly to this at least one inertial element 2 at a second end 302.

Each elastic blade 3 extends in a perpendicular plane to the pivot axis D and is substantially deformable in this perpendicular plane to the pivot axis D.

Each inertial element 2 extends between a lower basic plane PI and an upper basic plane PS.

The resonator mechanism 100 comprises axis stop means. These axial stop means comprise a lower axial stop 7 and/or an upper axial stop 8. These axial stop means are arranged to cooperate as stop rest with at least one of the movable components for protection of the blade resonator mechanism 100, and in particular of the elastic blades 3 belonging thereto, against axial shocks in the direction of the pivot axis D.

More particularly, these axial stop means comprise a lower axial stop 7 extending in the immediate vicinity of the lower basic plane PI of a particular inertial element 2 and arranged to limit the out-of-plane displacement of this particular inertial element 2, and/or an upper axial stop 8 extending in the immediate vicinity of the upper basic plane PS of such a particular inertial element 2 and arranged to limit the out-of-plane displacement of this particular inertial element 2 by direct contact with this inertial element 2. These particular axial stops arranged for a direct contact with the inertial element 2 will hereafter be given the references 73 and 83 respectively.

In fact, even if it is conceivable to position axial stops arranged to cooperate directly as stop rest with the elastic blades 3, such cooperation is not appropriate for elastic blades made from micro-machinable material, silicon or similar, because of the risk of deterioration or breakage. This is the reason why the axial stop means of the invention are preferably arranged to cooperate with rigid elements such as inertial elements or staffs.

More particularly the resonator mechanism 100 comprises such a lower axial stop 7 and such an upper axial stop 8 on either side of the same inertial element 2.

In a particular variant the lower axial stop 7 and/or the upper axial stop 8 has a lower 17 or upper 18 plane face perpendicular to the pivot axis D that forms a stop face cooperating with the inertial element 2 in question in the event of shock or similar.

In particular, the resonator mechanism 100 comprises a plurality of such inertial element 2, which extend between a lower overall plane PI and an upper overall plane PS.

More particularly, the resonator mechanism 100 comprises at least one lower axial stop 7 and at least one upper axial stop 8 on either side of the lower overall plane PI and of said upper overall plane PS, each of which is arranged to limit the out-of-plane displacement of the closest inertial element for the protection of the blade resonator mechanism 100 against axial shocks in the direction of the pivot axis D.

According to the invention the resonator mechanism 100 comprises a plurality of inertial elements 2, which extend over several parallel levels. More particularly, the resonator mechanism 100 comprises at least one intermediate axial stop, which is arranged between two such adjacent levels of inertial elements 2. More particularly, at least one intermediate axial stop is arranged in each interstice between two such levels.

More particularly, the resonator mechanism 100 comprises a plurality of levels of elastic blades 3, which all extend between two extreme, upper and lower, levels of inertial elements 2, which protect these elastic blades 3.

In particular, a staff 4 supports all or part of the axial stop means. This staff 4 is aligned on the pivot axis D and extends along this axis D. To avoid all interference and all friction, at least one elastic blade 3 has a recess or passage or an eye 6 arranged around the pivot axis D and without contact with the staff 4. This staff also comprises at least a lower axial stop 7 or an upper axial stop 8. More particularly, this staff 4 at the same time comprises at least one lower axial stop 7 and at least one upper axial stop 8.

More particularly, each elastic blade 3 comprises such a recess or such a passage or such an eye 6 and the staff 4 passes through all the levels of blades 3.

Naturally the staff 4 can also comprise at least one intermediate stop when the resonator mechanism 100 comprises inertial elements 2 distributed over parallel and spaced levels, between pairs of which such an intermediate axial stop can be located.

In a first embodiment this staff 4 is fixed to the structure 1, which can itself have at least one axial stop face.

Figure 2:
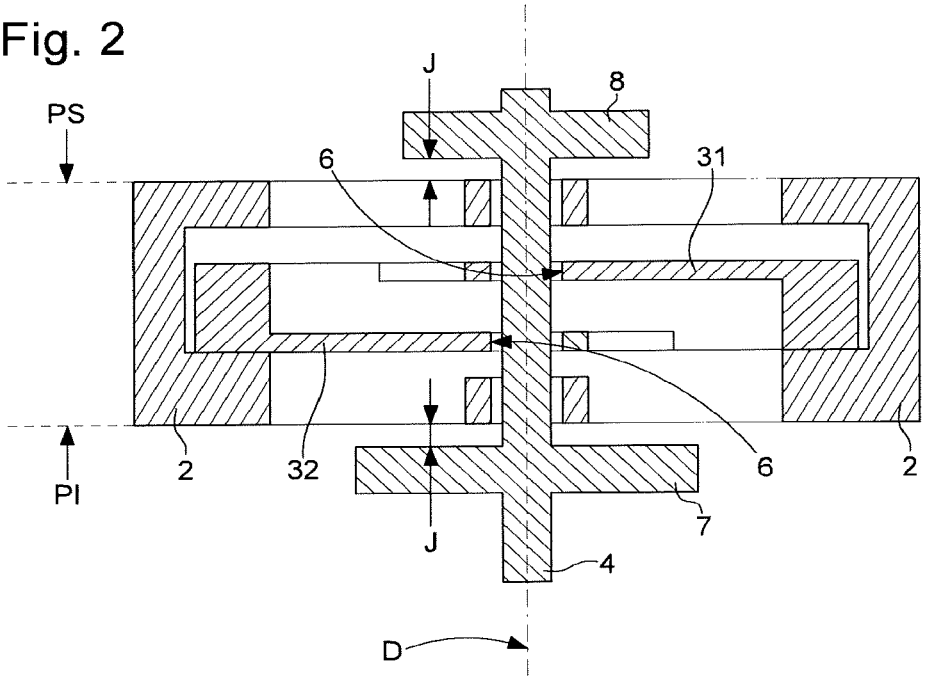
FIG. 2 is a sectional view along AA of the resonator mechanism of FIG. 1.

FIGS. 1 and 2 illustrate this first embodiment. The resonator mechanism 100 with elastic blades comprises two parallel levels of upper 31 and lower 32 elastic blades. These elastic blades 31 and 32 respectively extend in directions D1 and D2, which cross in projection over a plane parallel to these two levels at the level of a virtual pivot axis D, around which oscillates an inertial element 2, which is suspended and restored by these elastic blades 31 and 32 in relation to a fixed structure 1. The resonator mechanism 100 comprises axial stop means to indirectly protect the blades 31 and 32 in the case of shock, which are illustrated in a non-restrictive manner in the form of two discs centred on the pivot axis D: an upper disc of small diameter that is in particular, but non-restrictively transparent and then coupled to an inertial element 2 that also has a transparent axial part that allows the state of the blades to be verified and forms an upper axial stop 8 arranged to limit the shake of the inertial element 2 on the upper side, and a lower disc of larger diameter forming a lower axial stop 7 that is arranged to limit the shake of the inertial element 2 on the lower side opposite this upper side. The blades 31 and 32 each have an eye 6 at the level of the pivot axis D to allow passage of a staff 4, which here is held on the fixed structure and which supports this upper disc and this lower disc.

In a second embodiment this staff 4 is fixed to an inertial element 2 of the resonator mechanism 100 and the axial stop means belonging to this staff 4 are arranged to cooperate as stop rest with complementary stop faces belonging to the structure 1. More particularly, the axial stop means comprise an upper end face 48 and a lower end face 47 that are arranged to respectively cooperate with an upper complementary surface 18 and a lower complementary surface 17 of the structure 1.

Figure 3:
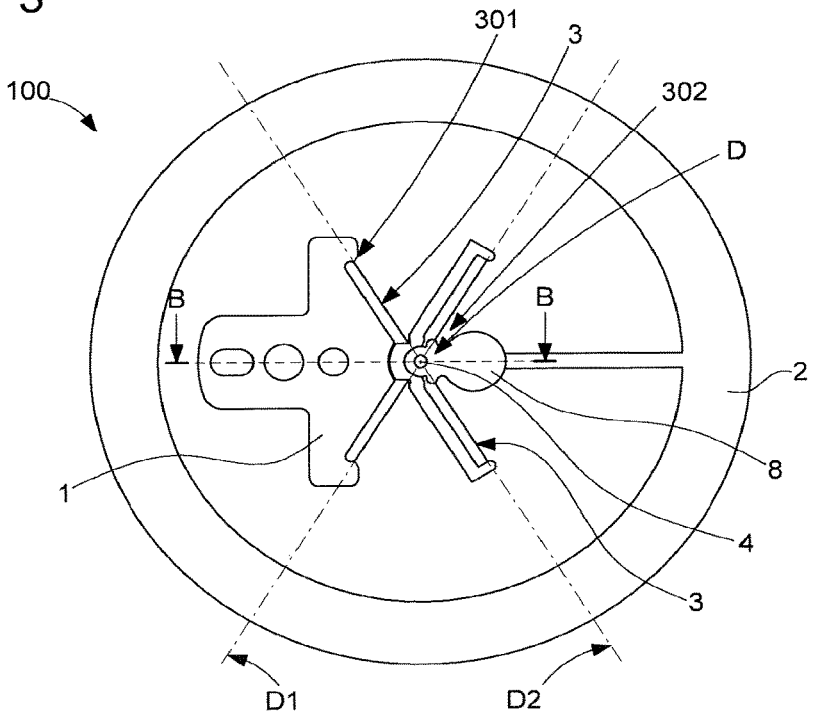
FIG. 3 is a schematic plan view of a second embodiment with another resonator mechanism with elastic blades comprising a single level of elastic blades arranged in the form of RCC pivots arranged head to tail, wherein the directions in which these blades extend cross at the level of a virtual pivot axis of an inertial element, which is suspended and restored by these elastic blades in relation to a fixed structure. The inertial element carries a shaft centred on the pivot axis, and at its two free ends, the upper and lower, this shaft comprises upper and lower end faces respectively arranged to cooperate with complementary upper and lower surfaces of the structure.
Figure 4:
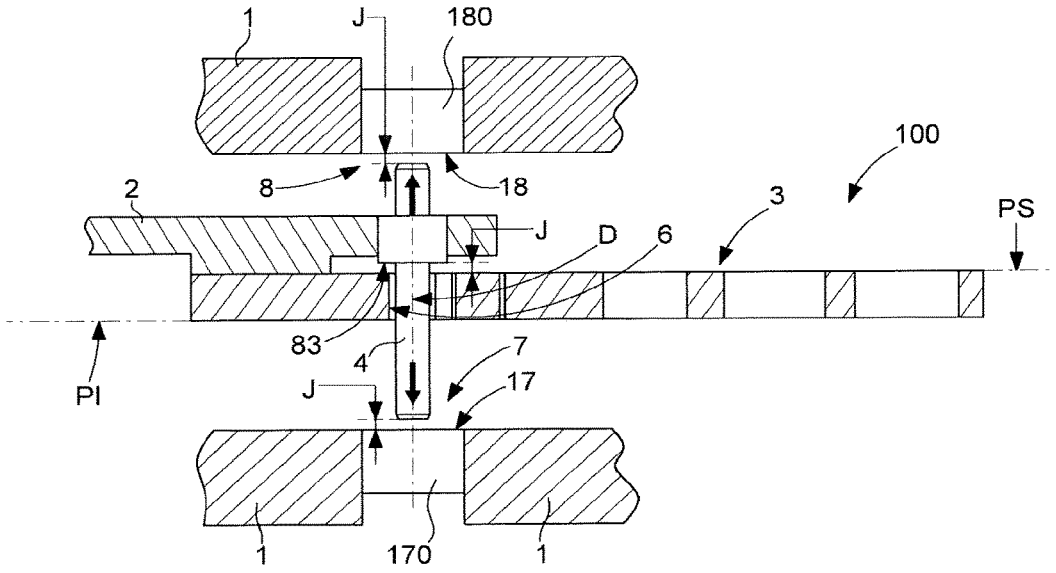
FIG. 4 is a sectional view along BB of the resonator mechanism of FIG. 3.

FIGS. 3 and 4 illustrate this embodiment. The resonator mechanism 100 here comprises a single level of elastic blades 3 arranged in the form of RCC pivots arranged head to tail, and directions D1 and D2 in which these blades 3 extend cross at the level of the virtual pivot axis of an inertial element 2, which is suspended and restored by these elastic blades 3 in relation to the fixed structure 1. The inertial element 2 supports a staff 4 centred on the pivot axis D, and at its two free, upper and lower, ends this staff comprises upper 48 and lower 47 end faces respectively arranged to cooperate with upper 18 and lower 17 complementary surfaces of the structure 1. In this variant the inertial element 2 also comprises another upper axial stop 83 that is usable during assembly to adjust the distance between the inertial element and the elastic blades 3.

Figure 5:
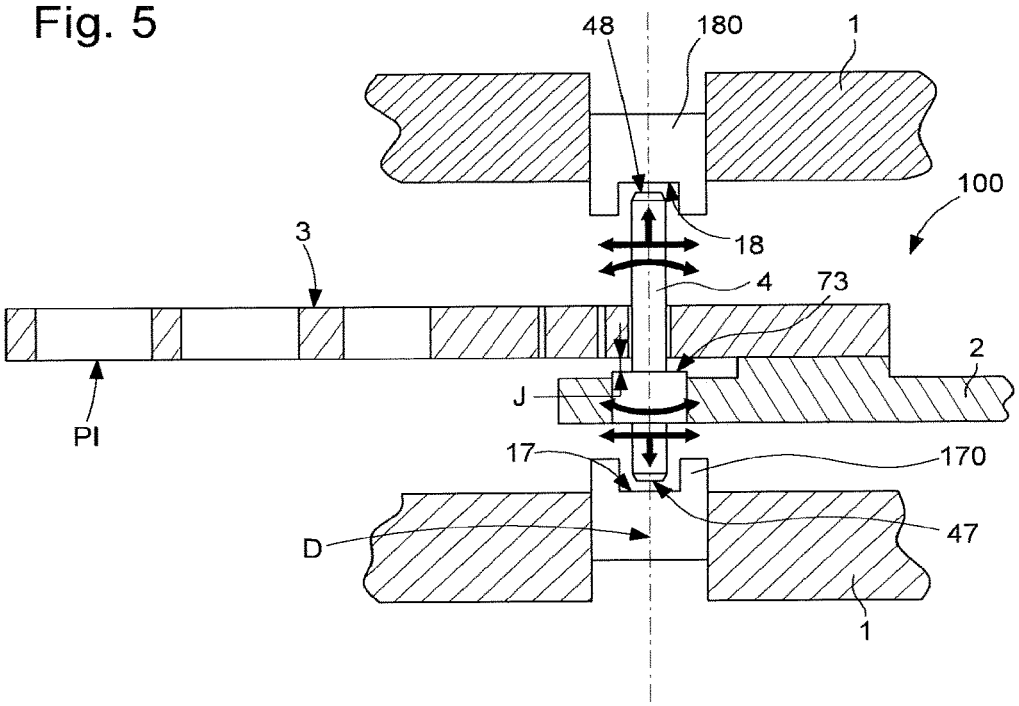
Figure 6:
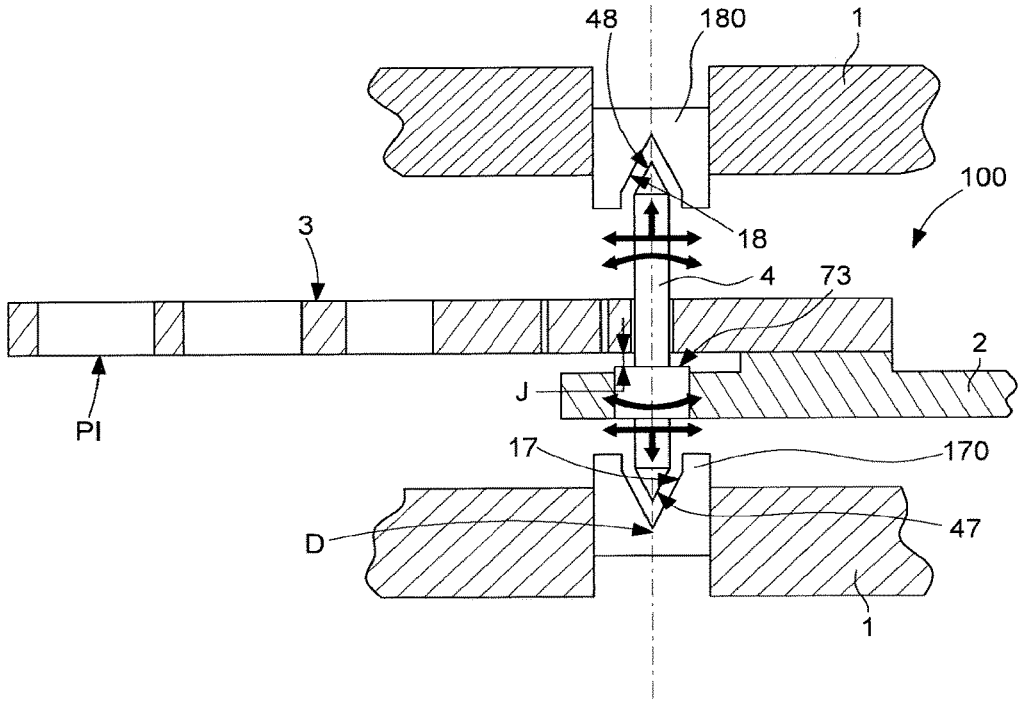
Figure 7:
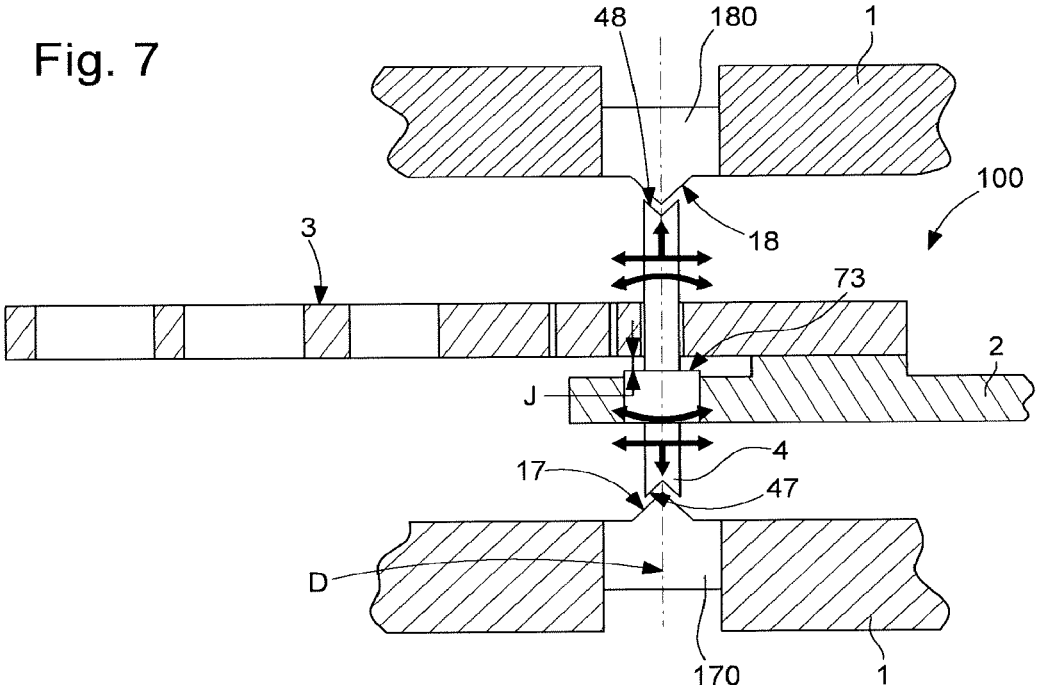

In a particular embodiment, as evident in FIGS. 5 to 7, these upper end faces 48, upper complementary surfaces 18, lower end faces 47 and lower complementary surfaces 17 are surfaces of revolution around the pivot axis D and have a complementary profile in pairs: male and female cylinders, male and female cones, which limits the radial path and also permits re-centring on this pivot axis D.

Naturally, the resonator mechanism 100 can also comprise a first staff 4 integral to the structure 1 and a second staff 4 integral to an inertial element 2.

In a particular embodiment the elastic blades 3 are straight. More particularly, directions D1, D2 in which these elastic blades 3 extend are crossed at the level of the pivot axis D in projection on a perpendicular plane to the pivot axis D.

In a particular embodiment at least one lower axial stop 7 or an upper axial stop 8 is made from sapphire or another transparent material.

In a variant, in the case of a plurality of inertial elements 2, the resonator mechanism 100 comprises complementary axial stop means to cooperate as stop contact with each inertial element 2 that are arranged to limit the out-of-plane displacement of the closest inertial element 2. More particularly, on either side of the set of inertial elements 2 belonging to it, this resonator mechanism 100 comprises at least one lower axial stopper 7 and at least one upper axis stopper 8, each arranged to limit the out-of-plane displacement of the closest inertial element 2.

More particularly, the configuration of FIG. 3 relates to a double RCC pivot type of resonator mechanism 100 with blades in V shapes arranged head to tail, but other geometries of flexible blade pivots that leave the axis zone free also allow implementation of the invention, like the configuration of FIG. 1 with superposed blades, which cross at the level of the pivot axis D in projection over a plane parallel to their plane.

The configurations of blade resonators often allow release from the zone around the pivot axis, which allows the simple addition of a staff 4 passing through the virtual pivot axis D of the blades. In particular, the space left free by the configuration of this double RCC remote center compliance) pivot configuration allows the addition of such a staff 4, which comprises axial stop means.

In a particular variant, in particular illustrated by FIG. 4, the staff is integral to an inertial element 2. This is generally attached to a monolithic component made from silicon or similar belonging to the elastic blades 3.

The variant of FIG. 3 comprises lower 170 and upper 180 stops that respectively carry an upper complementary surface 18 and a lower complementary surface 17, which are pressed into the structure 1, e.g. into a bridge or a plate, to allow a fine adjustment of the distance J between the stop and the staff, preferably in the range of between 20 and 70 micrometres. However, it is also possible to form these stops in a single piece with the support of the resonator plate and/or bridge) if this component is fabricated precisely. It is also conceivable for them to be screwed or mounted on a fine adjustment system such as a screw carriage or similar.

The material of these stops can be metal or also an elastomer to vary the damping of the shocks.

In a variant this mechanical interaction of stops with the inertial element or a staff can be completed with the addition of a magnetic interaction between the elements that are arranged to come into abutment, e.g. faces 18 and 48 and 17 and 47 respectively of FIGS. 5 to 7. This magnetic interaction then constitutes forming a shock absorber pad.

In relation to the pivot axis D a contact established on a small contact radius when the stop is close to the axis of rotation) is favourable with respect to friction when resting on the stop, the illustrated variants also comprise stops very close to the pivot axis D. It is, of course, possible to place stops on a larger radius, e.g. on the rim of an inertial arm or other.

Other configurations allow safety means to be added in different directions, as evident in FIGS. 5 to 7, and therefore further improve the shock resistance of the elastic blades.

Figure 8:
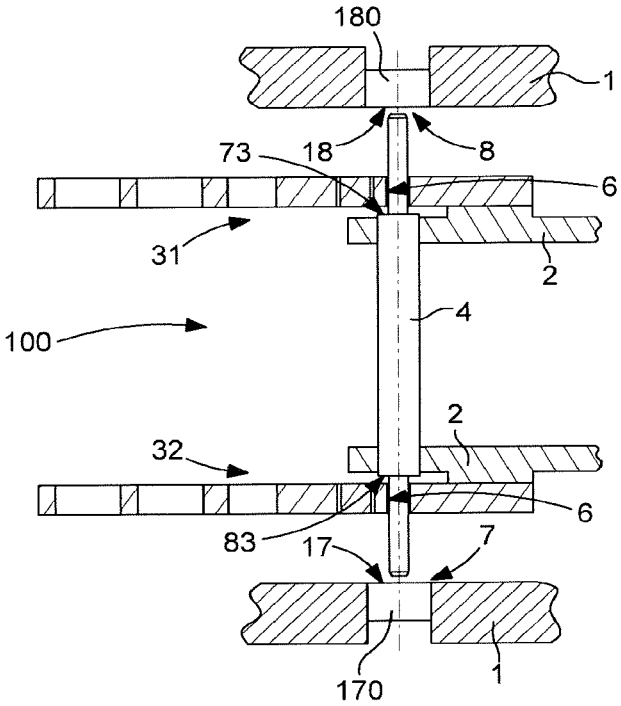
FIG. 8 is a sectional view passing through the pivot axis of another resonator mechanism where two distant levels of elastic blades are superposed. In the illustrated non-restrictive variant the inertial element cooperates with each level of elastic blades and a single shaft connects the different inertial elements and provides axial stop means for the whole of the resonator mechanism. This shaft has two shoulders, one of which is distant from the upper elastic blades and the other is distant from the lower elastic blades. The ends of this shaft cooperate in abutment position with complementary surface of the fixed structure as in the second embodiment of FIGS. 3 to 7.
Figure 9:
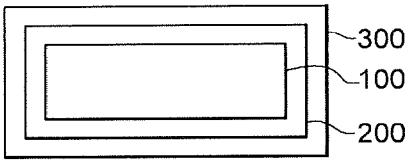
FIG. 9 is a block diagram showing a watch comprising a movement which itself comprises a resonator mechanism according to the invention.

FIG. 8 illustrates the superposition in the same resonator of several levels of elastic blades 3, wherein each level is associated with an inertial element 2 or at least with a particular level of an inertial element 2. In the illustrated non-restrictive variant an inertial element 2 cooperates with each level of elastic blades 3 and a single staff 4 connects the different inertial elements and provides the axis stop means for the entire resonator mechanism 100. In this variant this staff 4 comprises two shoulders, one of which forms a lower axial stop 73 for distance adjustment during assembly with the upper elastic blades 32, and in a similar manner the other forms an upper axial stop 83 for distance adjustment with the lower elastic blades 32.

The invention also relates to a timepiece movement 200 comprising at least one such resonator mechanism 100.

The invention also relates to a watch 300 comprising such a timepiece movement 200 and/or such a resonator mechanism 100.

What is claimed is:

1. A timepiece resonator mechanism comprising:

a structure and at least one inertial element arranged to oscillate in a pivoting movement around a pivot axis with the centre of inertia of said at least one inertial element aligned on said pivot axis, wherein said at least one inertial element is subjected to restoring forces exerted by a plurality of elastic blades, each of said plurality of elastic blades fixed directly or indirectly to said structure at a first end and fixed directly or indirectly to said at least one inertial element at a second end, and each of said plurality of elastic blades extends in a perpendicular plane to said pivot axis and is substantially deformable in said perpendicular plane to said pivot axis, wherein said resonator mechanism comprises axial stop means comprising at least a lower axial stop and/or an upper axial stop, and said axial stop means are arranged to cooperate as a stop rest with at least one of the plurality of elastic blades or the at least one inertial element for the protection of said resonator mechanism against axial shocks in the direction of said pivot axis, wherein said resonator mechanism comprises a plurality of said inertial elements, which extend over a plurality of parallel levels, and wherein said axial stop means of said resonator mechanism further comprises at least one intermediate axial stop, which is arranged between two adjacent levels of said plurality of parallel levels of said inertial elements.

2. The timepiece resonator mechanism according to claim 1, wherein at least one said plurality of inertial elements extends between a lower plane and an upper plane, and wherein said intermediate axial stop comprises at least a lower intermediate axial stop extending in the immediate vicinity of said lower plane of one of said plurality of inertial elements and/or an upper intermediate axial stop extending in the immediate vicinity of said upper plane of one of said plurality of inertial elements and arranged to limit the out-of-plane displacement of one of said plurality of inertial elements by direct contact with said one of said plurality of inertial elements.

3. The timepiece resonator mechanism according to claim 2, wherein said structure comprises said lower axial stop and said upper axial stop on either side of one of said plurality of inertial elements.

4. The timepiece resonator mechanism according to claim 2, wherein said lower axial stop and/or upper axial stop respectively comprise a lower and upper plane face perpendicular to said pivot axis and forming a stop face cooperating with one of said plurality of inertial elements in the case of a shock.

5. The timepiece resonator mechanism according to claim 1, wherein said plurality of said inertial elements extend between a lower overall plane and an upper overall plane, and wherein said structure comprises said lower axial stop on the side of said lower overall plane and said upper axial stop on the side of said upper overall plane, the lower axial stop and the upper axial stop each being arranged to limit the out-of-plane displacement of the closest inertial element for the protection of said blade resonator mechanism against axial shocks in the direction of said pivot axis.

6. The timepiece resonator mechanism according to claim 1, wherein said resonator mechanism comprises a staff aligned on said pivot axis, along which said staff extends, and which carries said axial stop means, and wherein each of said plurality of elastic blades has a recess or passage or an eye arranged around said pivot axis and without contact with said staff, and wherein said staff comprises at least said lower axial stop and/or said upper axial stop.

7. The timepiece resonator mechanism according to claim 6, wherein said staff is fixed to said structure.

8. The timepiece resonator mechanism according to claim 6, wherein said staff is fixed to said plurality of inertial elements of said resonator mechanism, and wherein said axial stop means belonging to said staff are arranged to cooperate as a rest stop with complementary stop faces belonging to said structure.

9. The timepiece resonator mechanism according to claim 8, wherein said axial stop means of said staff comprise an upper end face and a lower end face arranged to respectively cooperate with an upper complementary surface and a lower complementary surface belonging to said structure.

10. The timepiece resonator mechanism according to claim 9, wherein said upper end face, said upper complementary surface, said lower end face and said lower complementary surface are surfaces of revolution around said pivot axis and have a complementary profile in pairs.

11. The timepiece resonator mechanism according to claim 6, wherein said resonator mechanism comprises a first staff integral to said structure and a second staff integral to said plurality of inertial elements.

12. The timepiece resonator mechanism according to claim 1, wherein said axial stop means are arranged to cooperate as a stop contact with each one of said plurality of inertial elements such that said at least one lower axial stop and or said upper axial stop and said at least one intermediate axial stop are respectively arranged to limit the out-of-plane displacement of the closest inertial element for the protection of said resonator mechanism against axial shocks in the direction of said pivot axis.

13. The timepiece resonator mechanism according to claim 1, wherein said elastic blades are straight, and wherein the directions, in which said elastic blades extend are crossed at the level of said pivot axis in projection on a perpendicular plane to said pivot axis.

14. The timepiece resonator mechanism according to claim 1, wherein at least one said lower axial stop and/or one upper axial stop is made from sapphire or another transparent material.

15. The timepiece resonator mechanism according to claim 1, wherein the mechanical interaction between said axial stop means and surfaces of one of said plurality of inertial elements is completed by a magnetic interaction between said axial stop means and said surfaces of said one of said plurality of inertial elements.

16. The timepiece movement comprising at least one resonator mechanism according to claim 1.

17. A watch comprising at least one movement according to claim 16.

* * * * *